US010036148B1

(12) United States Patent
Rodriguez et al.

(10) Patent No.: US 10,036,148 B1
(45) Date of Patent: Jul. 31, 2018

(54) SOAP-DISPENSING FAUCET ASSEMBLY

(71) Applicants: Mario Rodriguez, South Gate, CA (US); Amanda Banda, South Gate, CA (US)

(72) Inventors: Mario Rodriguez, South Gate, CA (US); Amanda Banda, South Gate, CA (US)

( * ) Notice: Subject to any disclaimer, the term of this patent is extended or adjusted under 35 U.S.C. 154(b) by 0 days.

(21) Appl. No.: 15/481,086

(22) Filed: Apr. 6, 2017

(51) Int. Cl.
*E03C 1/04* (2006.01)
*E03C 1/046* (2006.01)
*A47K 5/12* (2006.01)

(52) U.S. Cl.
CPC ..... *E03C 1/046* (2013.01); *A47K 5/1217* (2013.01); *A47K 2005/1218* (2013.01)

(58) Field of Classification Search
CPC ..... E03C 1/0401
USPC ..... 4/675–678
See application file for complete search history.

(56) References Cited

U.S. PATENT DOCUMENTS 2,302,097 A * 11/1942 Beckman ..... A47L 17/00 134/103.1
4,625,896 A * 12/1986 Rocchelli ..... A47K 5/12 222/180
5,114,048 A * 5/1992 Minke ..... A47K 5/12 222/135
D341,875 S * 11/1993 Allen ..... A47K 5/12 D23/238
5,822,811 A * 10/1998 Ko ..... E03C 1/0401 4/675
5,906,319 A * 5/1999 Crowl ..... E03C 1/046 239/310
6,000,626 A * 12/1999 Futo ..... B05B 7/2464 239/333
6,602,010 B1 8/2003 Doyle et al.
6,718,568 B1 * 4/2004 Hensley ..... E03C 1/04 4/675
7,527,174 B2 * 5/2009 Meehan ..... A47K 1/08 141/332
7,565,713 B2 7/2009 Standish
7,647,653 B1 * 1/2010 Catania ..... A47K 5/1202 4/628
7,775,462 B2 8/2010 Herring et al.
8,065,758 B1 * 11/2011 Mendez ..... A47K 5/1202 4/654
8,407,828 B2 * 4/2013 Vogel ..... E03C 1/23 4/678
8,899,259 B2 * 12/2014 Jonte ..... E03C 1/0402 137/315.12
2004/0211000 A1 10/2004 Buonocore

* cited by examiner

*Primary Examiner* — Lori Baker

(57) ABSTRACT

A soap-dispensing faucet assembly for sinks includes a faucet that is configured to couple to a sink and a housing that is configured to couple to a surface below the sink. A nozzle, which is configured to spray water, is fluidically coupled to the faucet. A power module, a reservoir, and a pump are coupled to and positioned in the housing. The reservoir is configured to position fluids, such as liquid soap and liquid detergent. The pump is operationally coupled to the power module and is fluidically coupled to the reservoir. A tube is coupled to a front plate of the nozzle and extends from an opening in the front plate of the nozzle through the faucet. The tube is fluidically coupled to the pump. The pump is configured to motivate the fluids from the reservoir through the tube to be dispensed from the opening in the nozzle.

11 Claims, 4 Drawing Sheets

SOAP-DISPENSING FAUCET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to faucet assemblies and more particularly pertains to a new faucet assembly for sinks.

BRIEF SUMMARY OF THE INVENTION

An embodiment of the disclosure meets the needs presented above by generally comprising a faucet that is configured to couple to a sink and a housing that is configured to couple to a surface below the sink. A nozzle, which is configured to spray water, is fluidically coupled to the faucet. A power module, a reservoir, and a pump are coupled to and positioned in the housing. The reservoir is configured to position fluids, such as liquid soap and liquid detergent. The pump is operationally coupled to the power module and is fluidically coupled to the reservoir. A tube is coupled to a front plate of the nozzle and extends from an opening in the front plate of the nozzle through the faucet. The tube is fluidically coupled to the pump. The pump is configured to motivate the fluids from the reservoir through the tube to be dispensed from the opening in the nozzle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
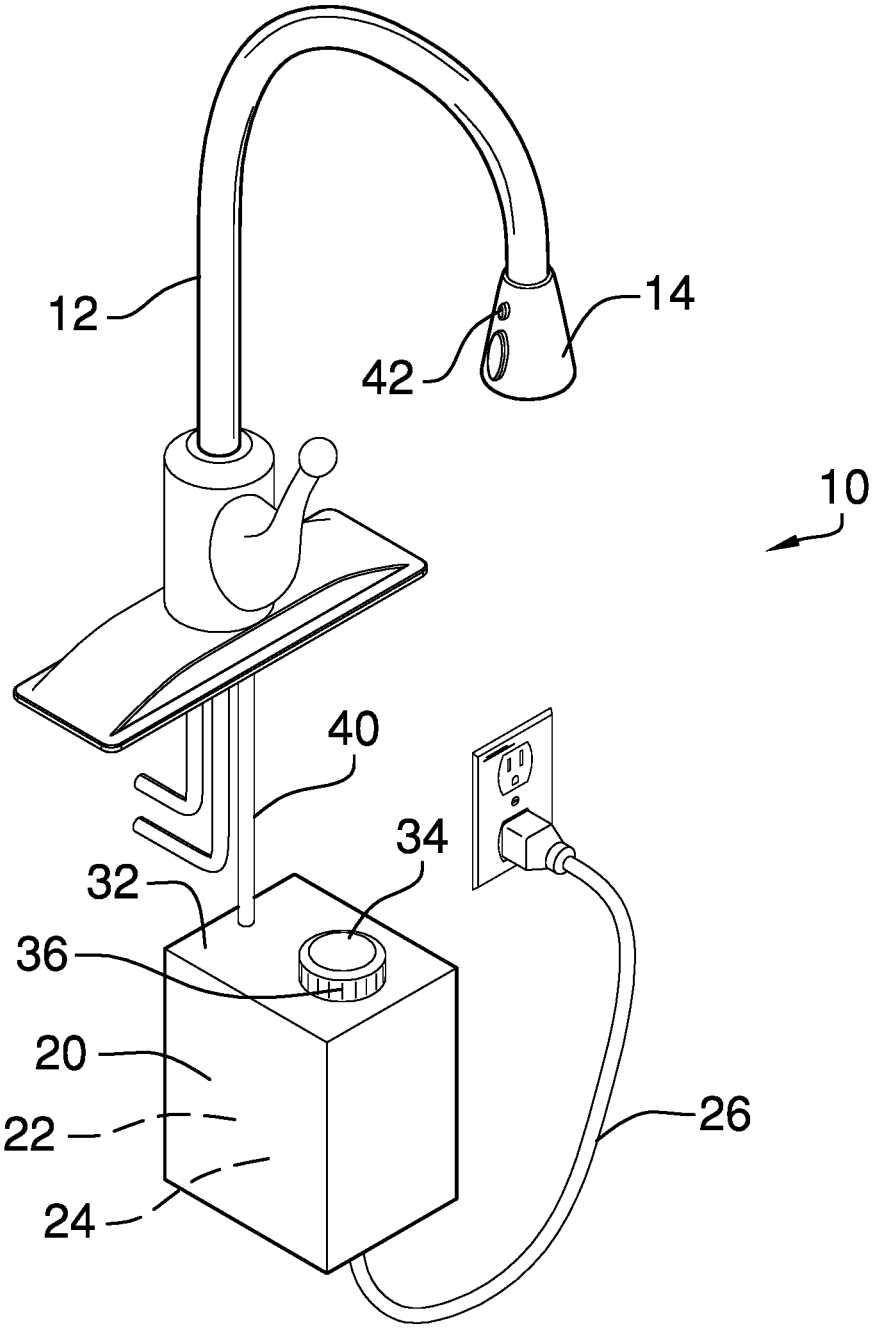
FIG. 1 is an isometric perspective view of a soap-dispensing faucet assembly according to an embodiment of the disclosure.
Figure 2:
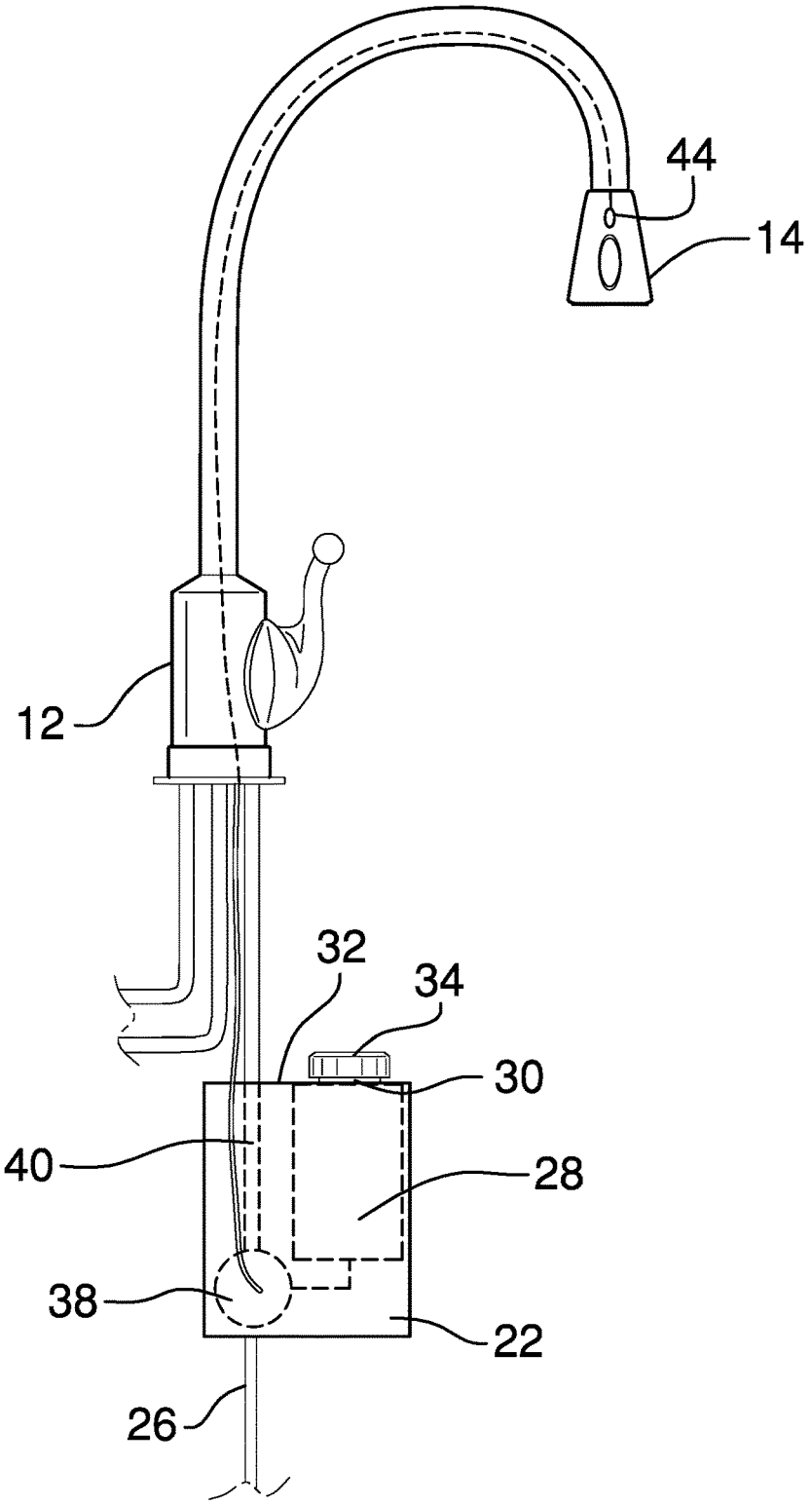
FIG. 2 is a side view of an embodiment of the disclosure.
Figure 3:
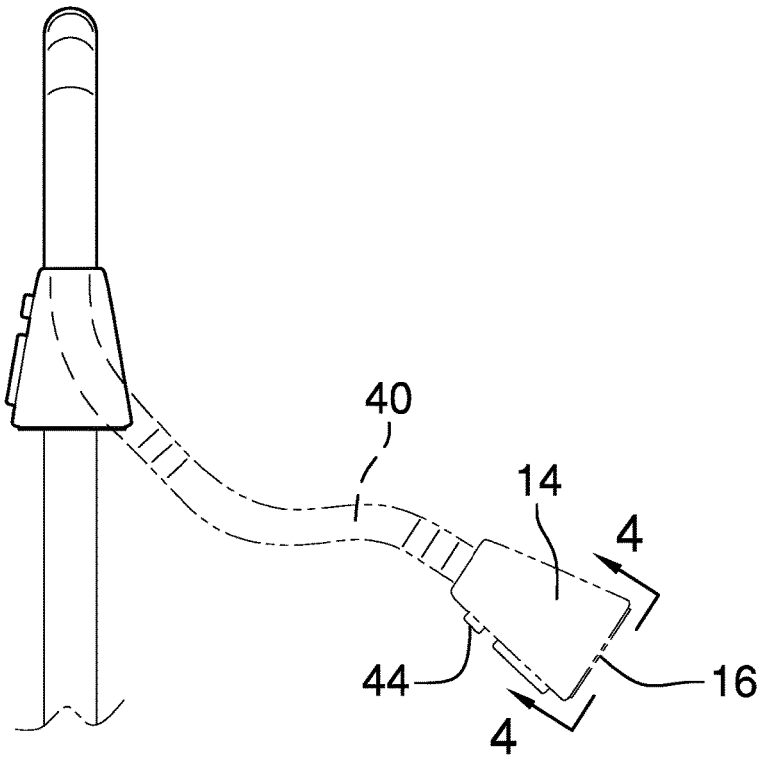
FIG. 3 is a front view of an embodiment of the disclosure.
Figure 4:
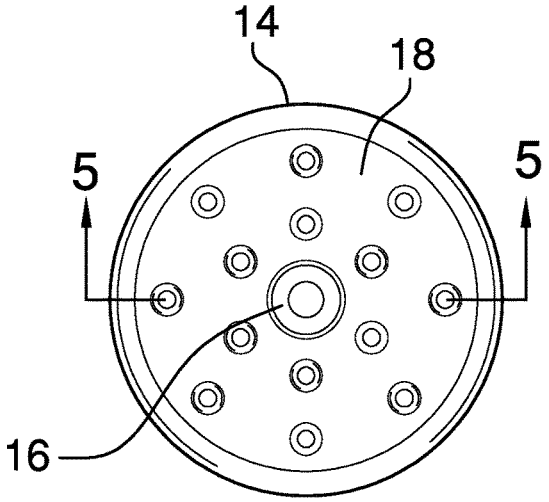
FIG. 4 is a bottom view of an embodiment of the disclosure.
Figure 5:
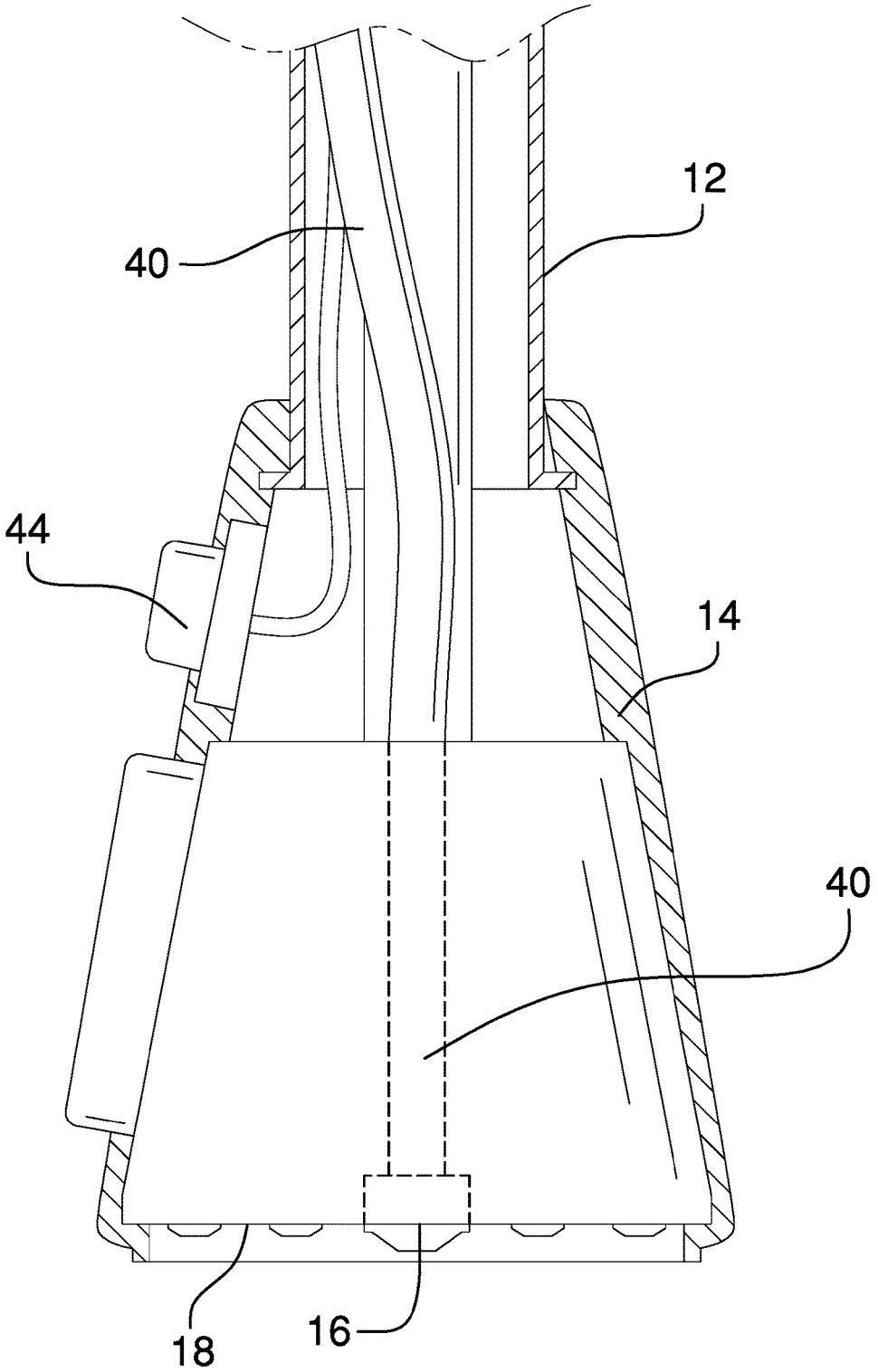
FIG. 5 is a cross-sectional view of an embodiment of the disclosure.

With reference now to the drawings, and in particular to FIGS. 1 through 5 thereof, a new faucet assembly embodying the principles and concepts of an embodiment of the disclosure and generally designated by the reference numeral 10 will be described.

As best illustrated in FIGS. 1 through 5, the soap-dispensing faucet assembly 10 generally comprises a faucet 12 that is configured to couple to a sink. A nozzle 14 is fluidically coupled to the faucet 12. The nozzle 14 is configured to spray water. In one embodiment, the nozzle 14 is selectively extensible from the faucet 12. An opening 16 is positioned in a front plate 18 of the nozzle 14. In one embodiment, the opening 16 is substantially centrally positioned in the front plate 18.

The assembly 10 also comprises a housing 20 that defines an internal space 22. The housing 20 is configured to couple to a surface below the sink. In one embodiment, the housing 20 is substantially rectangularly box shaped.

A power module 24 is coupled to the housing 20 and is positioned in the internal space 22. In one embodiment, the power module 24 comprises a cord 26. The cord 26 is configured to couple to a source of alternating current.

A reservoir 28 is coupled to the housing 20 and is positioned in the internal space 22. The reservoir 28 is configured to position fluids, such as liquid soap and liquid detergent.

A pipe 30 is coupled to and extends from the housing 20. The pipe 30 is fluidically coupled to the reservoir 28. The pipe 30 is positioned on a top 32 of the housing 20 and is externally threaded. The pipe 30 is configured to add the fluids, such as the liquid soap and the liquid detergent, to the reservoir 28. A cap 34 that is complementary to the pipe 30 is reversibly couplable to the pipe 30. The cap 34 is positioned to couple to the pipe 30 to selectively close the reservoir 28. The cap 34 has a rim 36. In one embodiment, the rim 36 is textured.

A pump 38 is coupled to the housing 20 and is positioned in the internal space 22. The pump 38 is operationally coupled to the power module 24. The pump 38 is fluidically coupled to the reservoir 28.

A tube 40 is coupled to the front plate 18 of the nozzle 14 and extends from the opening 16 through the faucet 12. The tube 40 is fluidically coupled to the pump 38. The pump 38 is configured to motivate the fluids from the reservoir 28 through the tube 40 to be dispensed from the opening 16 in the front plate 18 of the nozzle 14. In one embodiment, the tube 40 is configured to extend with the nozzle 14.

A controller 42 is coupled to the nozzle 14. The controller 42 is operationally coupled to the pump 38. The controller 42 is positioned to compel the pump 38 to motivate the fluids from the reservoir 28 through the tube 40 to be dispensed from the opening 16 in the front plate 18 of the nozzle 14. In one embodiment, the controller 42 comprises a button 44. The button 44 is depressible. The button 44 is configured to be depressed to compel the pump 38 to motivate the fluids from the reservoir 28 through the tube 40 to be dispensed from the opening 16 in the front plate 18 of the nozzle 14.

In use, the faucet 12 is configured to couple to the sink and the housing 20 is configured to couple to a surface below the sink. The pipe 30 that is positioned on the housing 20 is configured to add the fluids, such as the liquid soap and the liquid detergent, to the reservoir 28. The cap 34 is positioned to couple to the pipe 30 to selectively close the reservoir 28. The button 44 is configured to be depressed to compel the pump 38 to motivate the fluids from the reservoir 28 through the tube 40 to be dispensed from the opening 16 in the front plate 18 of the nozzle 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A soap-dispensing faucet assembly comprising:

a faucet configured for coupling to a sink, said faucet being configured to dispense water;

a nozzle fluidly coupled to said faucet such that said nozzle is configured for spraying the water through said nozzle;

an opening positioned in a front plate of said nozzle;

a housing defining an internal space, said housing being configured for coupling to a surface below the sink;

a power module coupled to said housing and positioned in said internal space;

a reservoir coupled to said housing and positioned in said internal space, said reservoir being configured for positioning fluids therein;

a pump coupled to said housing and positioned in said internal space, said pump being operationally coupled to said power module, said pump being fluidly coupled to said reservoir;

a tube coupled to said front plate of said nozzle and extending from said opening through said faucet, said tube being fluidly coupled to said pump; and wherein said tube is positioned on said pump such that said pump is configured for urging the fluids from said reservoir through said tube for dispensing from said opening in said front plate of said nozzle.

2. The assembly of claim 1, further including said opening being substantially centrally positioned in said front plate.

3. The assembly of claim 1, further including said housing being substantially rectangularly box shaped.

4. The assembly of claim 1, further including said power module comprising a cord, said cord being configured for coupling to a source of alternating current.

5. The assembly of claim 1, further including a pipe coupled to and extending from said housing, said pipe being fluidly coupled to said reservoir, said pipe being positioned on a top of said housing, wherein said pipe is positioned on said housing such that said pipe is configured for adding fluids to said reservoir.

6. The assembly of claim 5, further comprising:

said pipe being externally threaded;

a cap complementary to said pipe, said cap being reversibly couplable to said pipe; and wherein said cap is positioned for coupling to said pipe for selectively closing said reservoir.

7. The assembly of claim 6, further including said cap having a rim, said rim being textured.

8. The assembly of claim 1, further including said nozzle being selectively extensible from said faucet, said tube being configured for extending with said nozzle.

9. The assembly of claim 1, further including a controller coupled to said nozzle, said controller being operationally coupled to said pump, wherein said controller is positioned on said nozzle such that said controller is positioned for compelling said pump to motivate the fluids from said reservoir through said tube for dispensing from said opening in said front plate of said nozzle.

10. The assembly of claim 9, further including said controller comprising a button, said button being depressible, wherein said button is positioned on said nozzle such that said button is configured for depressing for compelling said pump to motivate the fluids from said reservoir through said tube for dispensing from said opening in said front plate of said nozzle.

11. A soap-dispensing faucet assembly comprising:

a faucet configured for coupling to a sink, said faucet being configured to dispense water;

a nozzle fluidly coupled to said faucet such that said nozzle is configured for spraying the water through said nozzle, said nozzle being selectively extensible from said faucet;

an opening positioned in a front plate of said nozzle, said opening being substantially centrally positioned in said front plate;

a housing defining an internal space, said housing being configured for coupling to a surface below the sink, said housing being substantially rectangularly box shaped;

a power module coupled to said housing and positioned in said internal space, said power module comprising a cord, said cord being configured for coupling to a source of alternating current;

a reservoir coupled to said housing and positioned in said internal space, said reservoir being configured for positioning fluids, such as liquid soap and liquid detergent;

a pipe coupled to and extending from said housing, said pipe being fluidly coupled to said reservoir, said pipe being positioned on a top of said housing, said pipe being externally threaded, wherein said pipe is positioned on said housing such that said pipe is configured for adding fluids, such as the liquid soap and the liquid detergent, to said reservoir;

a cap complementary to said pipe, said cap being reversibly couplable to said pipe, wherein said cap is positioned for coupling to said pipe for selectively closing said reservoir, said cap having a rim, said rim being textured;

a pump coupled to said housing and positioned in said internal space, said pump being operationally coupled to said power module, said pump being fluidly coupled to said reservoir, a tube coupled to said front plate of said nozzle and extending from said opening through said faucet, said tube being fluidly coupled to said pump, wherein said tube is positioned on said pump such that said pump is configured for motivating the fluids from said reservoir through said tube for dispensing from said opening in said front plate of said nozzle, said tube being configured for extending with said nozzle;

a controller coupled to said nozzle, said controller being operationally coupled to said pump, wherein said controller is positioned on said nozzle such that said controller is positioned for compelling said pump to motivate the fluids from said reservoir through said tube for dispensing from said opening in said front plate of said nozzle, said controller comprising a button, said button being depressible, wherein said button is positioned on said nozzle such that said button is configured for depressing for compelling said pump to motivate the fluids from said reservoir through said tube for dispensing from said opening in said front plate of said nozzle; and wherein said faucet is configured for coupling to the sink and said housing is configured for coupling to a surface below the sink, wherein said pipe is positioned on said housing such that said pipe is configured for adding fluids, such as the liquid soap and the liquid detergent, to said reservoir, wherein said cap is positioned for coupling to said pipe for selectively closing said reservoir, wherein said button is positioned on said nozzle such that said button is configured for depressing for compelling said pump to motivate the fluids from said reservoir through said tube for dispensing from said opening in said front plate of said nozzle.

* * * * *